United States Patent [19]

Brighenti

[11] Patent Number: 4,891,939

[45] Date of Patent: Jan. 9, 1990

[54] SYSTEM FOR THE CRYOGENIC PROCESSING AND STORAGE OF COMBUSTION PRODUCTS OF HEAT ENGINES

[75] Inventor: Attilio Brighenti, Venice, Italy

[73] Assignee: Tecnomare S.p.A., Venice, Italy

[21] Appl. No.: 276,906

[22] Filed: Nov. 28, 1988

[30] Foreign Application Priority Data

Dec. 4, 1987 [IT] Italy ..... 22885 A/87

[51] Int. Cl.[4] ..... F02M 25/06

[52] U.S. Cl. ..... 60/278; 60/281; 123/567

[58] Field of Search ..... 60/278, 281; 123/567

[56] References Cited

U.S. PATENT DOCUMENTS 2,895,291 7/1959 Lewis ..... 60/279

3,559,402 2/1971 Stone ..... 60/279

3,775,976 12/1973 Karig ..... 60/279

*Primary Examiner*—Douglas Hart

*Attorney, Agent, or Firm*—Hedman, Gibson, Costigan & Hoare

[57] ABSTRACT

A system for the cryogenic processing and storing the combustion product of a heat engine, in which the cooled and compressed anhydrous gases are fed through a liquefying/superheating heat exchanger to a cryogenic condensation/collection vessel for the carbon dioxide which is liquefied therein by the combustion oxygen which is stored in the liquid state in a cryogenic oxygen tank and traverses said cryogenic condensation/collection vessel through a coil, said liquid oxygen of the cryogenic oxygen tank being superheated while simultaneously partially liquefying the carbon dioxide in said liquefying/superheating heat exchanger while the oxygen and inert gases present in said cryogenic condensation/collection vessel are recovered. Modifications are also provided.

4 Claims, 3 Drawing Sheets

SYSTEM FOR THE CRYOGENIC PROCESSING AND STORAGE OF COMBUSTION PRODUCTS OF HEAT ENGINES

This invention relates to a system for the cryogenic processing and storage of combustion products by which the gaseous combustion products of a heat engine which is unable be fed directly from or to exhaust directly into the atmosphere can be collected easily and economically in at least one small-volume collection vessel at low energy cost, said system having a very small overall weight. More specifically but not exclusively, said system finds its main application in the power generation systems of heat engines installed on board vehicles, or of fixed underwater systems, particularly if intended for deep water with the requirement of considerable self-sufficiency between two restocking and the next, especially if in addition to this requirement there is the need to maintain constant system mass so that a state of balance between weight and buoyancy exists at all times during the delivery of energy.

A further potential application of the system according to the invention exists where vehicles or plant, including terrestrial or aerospatial, are required to operate in environments deprived of or poor in oxygen, and with restrictions in the facility for free exhaust of the gaseous combustion products into the environment, thus dictating the need to store or chemically process them. Mechanical power generation systems using heat engines, particularly internal combustion engines, have been known for some time, these being fed by a gas mixture at atmospheric pressure or boosted to a virtually constant pressure within a specific range. This mixture consists essentially of inert gases and oxygen contained in the engine exhaust gas, suitably cooled by a coolant, usually water, plus further oxygen added to make it up to its required molar fraction, usually between 20 and 25%, to thus restore the combustion-supporting power of the gas mixture fed to the engine.

The inert gases present in said mixture can be nitrogen, argon, carbon dioxide and water vapour, the two latter being engine combustion products.

Various researchers and designers have proposed various systems operating mainly with one or more of said gases depending on the gas cooling temperature and the intrinsic characteristics of the methods used.

All these systems have the common requirement of separating and/or diverting from the engine exhaust gas that part actually produced by the combustion, ie carbon dioxide and water vapour, to keep the mass and thus the pressure of the gas in the recirculation system constant.

Said systems also have the common requirement of a storage tank and an oxygen feed plant.

These two requirements are also common to external combustion heat engines operating in an anaerobic environment, such as a Stirling or Rankine cycle, with the obvious simplification that in this case the gaseous combustion products are already separated from the gas which operates the engine thermodynamic cycle.

The aforesaid systems have been particularly designed to generate mechanical energy on board vehicles and underwater installations, and in particular for propelling vehicles at considerable water depth which cannot be fed from or exhausted into the atmosphere. It is in this field of application, for which in fact said systems were originated, that the limits and technical drawbacks overcome by the present invention emerge. These limits arise because one or more of the following requirements are not satisfied:

(a) the need to limit the amount of mechanical energy consumed in expelling or treating the excess exhaust gas, and thus maximize the useful self-sufficiency of the system;

(b) the need to keep this energy consumption constant or nearly constant as a proportion of total energy consumption for all depths at which the system is used, and thus maintain the useful self-sufficiency of the system constant with depth;

(c) the need to keep the total mass of a hydrostatically-supported underwater vehicle constant at all times during navigation;

(d) the need to use for only useful combustion most and if possible the whole of the oxygen mass stored and transported on board, without penalizing dispersion towards the external environment;

(e) finally, the need to obtain high power/mass and useful energy/mass ratios for the system.

In a first system known in the state of the art, a part of the gaseous combustion products of a total-recycle diesel engine is discharged to the outside by compressing their excess fraction to a hydrostatic pressure corresponding to the water depth at which the system is used. However, such a system uses a large part of the mechanical energy produced by the engine in operating the compressor even when the vehicle is travelling at a depth of just a few hundred meters, and in particular has a limited depth of application, variable according to the engine efficiency and the system, at which the entire mechanical power output of the engine would have to be used to operate the compressor.

To this drawback must be added that fact that to keep the total mass of the system constant (requirement c) a seawater ballast system must be provided able to contain a mass equivalent to that of the gas expelled during operation. This system must also be adjustable and therefore be provided with feed and discharge valves and pumps, with consequent increase in system weight, energy requirement and cost.

In addition to said drawbacks which derive from the fact that requirements (a), (b) and (c) are not satisfactorily solved, there is the further drawback that the compressor expels as discharge a mixture containing a fraction of residual combustion oxygen which cannot be ignored and which varies from about 8% to 15% by volume depending on the feed to the diesel engine, which as is well known must operate with an adequate excess of combustion support power in its intake mixture, and thus contrary to requirement (d). A second known system for handling the exhaust gas of a closed-cycle diesel engine comprises cooling and dehumidifying the expelled gas and then absorbing the carbon dioxide produced by the combustion in an aqueous potassium hydroxide solution. Although this system satisfies requirements (a), (b), (c) and (d) it does not adequately satisfy requirement (e) considering the known fact that one kg of potassium hydroxide can absorb less than one kg of carbon dioxide.

Thus, event if the solvent mass is not initially taken into account, the system must comprise an additional apparatus for handling and storing a mass of potassium hydroxide greater than the mass of carbon dioxide produced by the total consumption of the oxygen and fuel reserves. If the mass of water required to keep the potassium hydroxide in at least saturated solution is also taken into account, the additional mass of this apparatus becomes overall equal to more than two and a half times the total mass of carbon dioxide produced by said consumption.

There is therefore an obvious considerable penalty in this system with regard to requirement (e).

A third known system for handling the exhaust gas of a total-recycle diesel engine comprises absorbing carbon dioxide in seawater in a suitable mass transfer vessel in which the expelled gas and said water are put into forced circulation at atmospheric or slightly higher than atmospheric pressure.

As water has a well known low capacity for absorbing this gas, it cannot be stored on board a vehicle in sufficient quantity for said purpose and must therefore be fed into the mass transfer vesseel from the external environment, and when it has absorbed the carbon dioxide it has to be expelled again by a positive displacement device with valve control.

The need for a water feed and expulsion device means that connections have to be made with the external environment by pipes and high-pressure valve elements in continuous and alternating operation, with the danger of relatively frequent faults because of the wear of sliding parts and seals both by the solid particles suspended in the seawater feed and by the expelled acid water. Again, to satisfy requirement (c) it is necessary to compensate the mass loss due to the expulsion of the absorbed carbon dioxide, so requiring a seawater ballast system with drawbacks analogous to those arising for the same reason in the already described first system.

In a fourth system known in the state of the art for handling the exhaust gas of a total-recycle diesel engine, after the gases expelled by the engine have been cooled and dehumidified, their excess fraction is compressed to a suitable pressure and absorbed by osmosis through a filter device through which said gases flow on one side and seawater at the environmental hydrostatic pressure flows on the other side. In this manner the carbon dioxide, urged by a large partial pressure gradient, permeates through the filter element towards the water, whereas the oxygen present in the mixture, and subjected to a lesser partial pressure gradient, is retained on the low pressure side as a residue and is partially recovered.

This system therefore limits the compression pressure and the power used for this expulsion and maintains them constant for all depths at which the system is used, but requires the use of a filter elements subjected to high pressure difference between the water side and gas side and therefore more structurally stressed the greater the depth at which it is used.

Particularly at a depth of some thousands of meters this component can become critical and, if it can be produced at all, costly and heavy.

To all this must be added the drawback already mentioned for the said first and third system regarding the need for a ballast installation of considerable volume to satisfy requirement (c), and comprising valves, seals and pumps also subjected to high pressure.

Finally, even if the aforesaid drawbacks involved in the use of underwater power generation systems at considerable depth could be overcome, they would always remain penalized relative to requirement (e), in addition to their cost.

It has now become apparent that the drawbacks of all the aforesaid systems derive from the fact that said systems consider the problem of storing and feeding the combustion support (oxygen) and the problem of handling the excess gas produced by the combustion as independent problems to be solved separately.

The object of the present invention is to obviate the aforesaid drawbacks of known systems by providing a system for processing the combustion products of heat engines which totally satisfies the aforesaid requirements (a) to (e), by convenient interaction of the functions involving liquid-state storage, heating and feed of the combustion support and/or of the fuel, with the handling, by cooling, condensing and liquid-state storage, of the excess gases produced during engine combustion.

In this respect, to effectively store a gas such as carbon dioxide in a restricted space it has to be liquefied, however to limit the mechanical work required for said liquefaction to a minimum it is necessary to reduce the liquefaction pressure as much as possible, this being done by cooling said gas by means of at least one fluid of very low temperature.

In other words, the system according to the invention uses liquid oxygen as the combustion support stored in at least one suitable vessel, to then use the cryogenic power available by its vaporization for the low-pressure liquefaction of the carbon dioxide produced by the combustion, which is then collected and stored liquefied in at least one suitable vessel, the oxygen associated with the excess exhaust gas present as uncondensable residue in the carbon dioxide liquefaction being recovered usefully and totally, with vaporization of the liquid combustion support as required for combustion in the heat engine.

It is also apparent that if heat engines fed with gaseous fuels such as methane etc. are used, the system according to the invention can also utilize the cryogenic power of said fuels in their liquid state to further lower the carbon dioxide liquefaction temperature and pressure and consequently the mechanical work required of the system.

The system for processing and storing the combustion products of a heat engine the exhaust gases of which are fed through a cooling heat exchanger to a condensate separator which feeds a mixing vessel into which make-up oxygen is fed through a control valve, and a dehydration circuit for the excess exhaust gases which are fed to a compressor and then to a heat exchanger for cooling the compressed anhydrous gases, is characterised according to the present invention in that the exit of said heat exchanger for cooling the compressed anhydrous gases is connected, by way of a liquefying/superheating heat exchanger to a cryogenic carbon dioxide condensation/collection vessel which, traversed by at least one liquid oxygen evaporation coil in closed circuit by way of a cryogenic oxygen tank containing said liquid oxygen maintained at constant pressure, is connected, possibly by way of a pressure compensator, to said make-up oxygen control valve to which said cryogenic oxygen tank is also connected by way of said liquefying/superheating heat exchanger and, if provided, said pressure compensator.

According to a further embodiment of the present invention said liquefying/superheating heat exchanger consists of at least one coil inserted in said cryogenic carbon dioxide condensation/collection vessel and connected respectively to said said cryogenic oxygen tank and to said make-up oxygen control valve. Finally, according to a further embodiment of the present invention, applicable when the heat engine fuel is a gaseous fuel liquefiable at low temperature, ie substantially at a temperature of less than −56.4° C., such as methane, the exit of said cooling heat exchanger for the compressed anhydrous gases is also connected, by way of a second liquefying/superheating heat exchanger, to a second cryogenic carbon dioxide condensation/collection vessel which, traversed by at least one liquid fuel gas evaporation coil in closed circuit by way of a cryogenic fuel gas tank containing said liquefied fuel gas maintained at constant pressure, is also connected, possibly by way of a pressure compensator, to said make-up oxygen control valve, said cryogenic liquefied fuel gas tank also being connected to the heat engine feed by way of said second liquefying/superheating heat exchanger.

The invention is described hereinafter in greater detail with reference to the accompanying drawings which represent preferred embodiments thereof given by way of non-limiting example only in that technical, technological or constructional modifications can be made thereto but without leaving the scope of the present invention.

Figure 1:
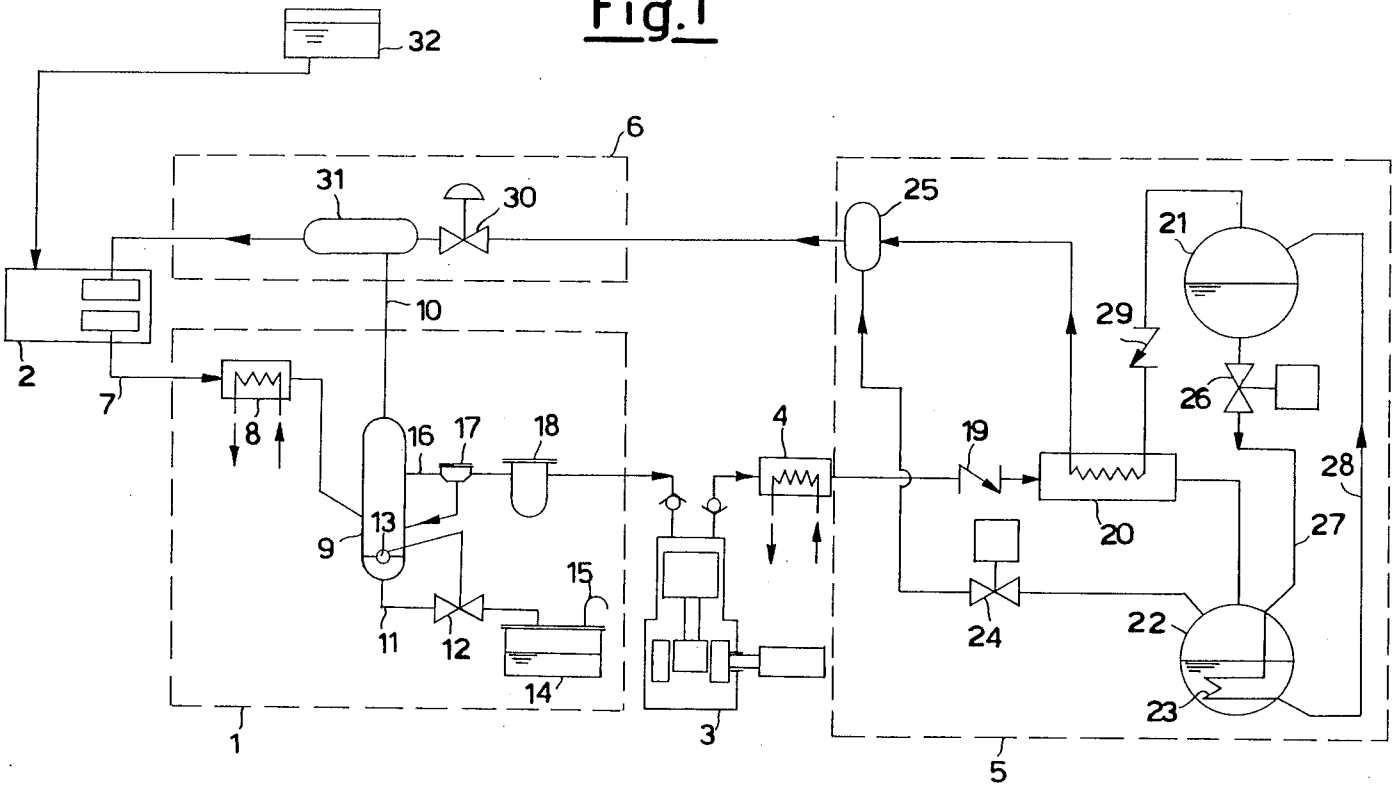
FIG. 1 is a process flow diagram of a heat engine using the combustion product processing and storage system constructed in accordance with the invention.

With reference to the figures, the process flow diagram of FIG. 1 comprises a cooling and dehydration unit 1 for the exhaust gases of the heat engine 2, a compressor 3, a heat exchanger 4 for cooling the compressed anhydrous gases, the cryogenic processing and storage system 5 for combustion products according to the present invention, and a gas regeneration unit 6.

The exhaust gases expelled by the heat engine 2 at high temperature, typically between 350° and 500° C., enter the line 7, are cooled in the heat exchanger 8 to a temperature slightly higher than the environmental cold source, ie the seawater and atmosphere surrounding the system. Said heater exchanger 8 can be cooled either directly by the fluid of the external environment, ie water or air, or by an intermediate thermovector fluid cooled by the external environment in a further heat exchanger (not shown). In the case of spatial applications, this latter heat transfer must be by radiation into that half of space which is in shadow with respect to solar radiation.

The cooled mixture then enters the condensate separator 9, from which the dehumidified fraction leaves through the recirculation line 10, the condensate leaves through the drain line 11 from which it passes through the valve 12 operated by the level controller 13 and is collected in the tank 14 with a vent 15 leading to the interior of an atmospheric pressure container containing the engine 2, and the excess gas present in the separator 9 due to the combustion leaves through the line 16. The gas present in the line 16, equivalent in mass flow to the increase per unit time of the dry gas mass produced by combustion in the engine, consists of a mixture containing carbon dioxide, unconsumed oxygen, water vapour and inert gas, ie not produced by the combustion and only limiting its maximum temperature. For the purposes of the present invention the precise nature of the inert gas is not a determining factor, however it will be apparent hereinafter that the energy used in compressing the gas stream through 16 is a minimum if this inert gas is mainly carbon dioxide. The gas flowing through the line 16 passes through a dehydration circuit for the excess exhaust gases, which consists of a condensate separator 17 and a dehumidification filter 18 containing hygroscopic substances (typically silica gel) on which the residual water vapour contained in the mixture is almost totally adsorbed.

The cooled anhydrous gas leaves the cooling and dehydration unit 1 by the work of the compressor 3 which draws in the mixture and compresses it to a pressure suitable for liquefying the carbon dioxide in said cryogenic processing and storage system 5, said pressure being determined by the mass and enthalpy balances on said system 5. Downstream of each stage of the compressor 3, whether single or multi-stage, there is provided a heat exchanger analogous to the heat exchanger 8 to minimize the work of compression and the enthalpy input to the system 5.

The anhydrous compressed gas enters said system 5 through the non-return valve 19 and passes through the liquefying/superheating heat exchanger 20 in which said mixture is further cooled and the carbon dioxide partially liquefied, said gas being cooled by the saturated oxygen vapour from the cryogenic oxygen tank 21, which is simultaneously superheated in said heat exchanger 20.

The carbon dioxide liquefaction is completed in the cryogenic carbon dioxide condensation/collection vessel 22 cooled by the liquid oxygen, which evaporates at lower temperature in the coil 23.

Those inert gases other than carbon dioxide and oxygen present in the compressed anhydrous gas are not condensable and are recovered and fed through the valve 24 and a pressure compressor 25 to said unit 6 for regenerating the engine gas. The valve 24 is operated by a suitable control system in accordance with the temperature and pressure within the vessel 22.

The liquid oxygen present in the cryogenic tank 21 is fed through the delivery valve 26 to the coil 23 where it evaporates to withdraw heat from the carbon dioxide contained in said cryogenic condensation/collection vessel 22 which is situated below the tank 21 to allow natural oxygen circulation by density difference between the descending line 27 and the rising line 28 thus avoiding the need to use complex and critical pumps for the liquid oxygen. The delivery valve is operated but a suitable control system for maintaining the pressure in the cryogenic oxygen tank 21 at a predetermined value exceeding the intake pressure of the engine 2.

The oxygen present in the saturated vapour phase in 21 in drawn into the unit 6 by the pressure difference between the tank 21 and the engine gas regeneration unit 6, by passing through the non-return valve 29, the liquefying/superheating heat exchanger 20 and the pressure compensator 25. The oxygen vapour is heated in said heat exchanger 20 to a temperature enclose to ambient and is mixed in the pressure compensator 25 with the oxygen and any recovered inert gases from the cryogenic vessel 22.

The make-up oxygen control valve 30 feeds into the mixing vessel 31 a quantity of oxygen-rich gas flowing from the pressure compensator 25 by pressure difference and able, when added to the oxygen-deficient gas from the condensate separator 9 through the recirculation line 10, to recreate a mixture having a combustion-support power predetermined on the basis of the characteristics of the heat engine 2 and the type of inert gas used.

In FIG. 1 the reference numeral 32 indicates the liquid or gaseous fuel tank for the heat engine 2.

Figure 2:
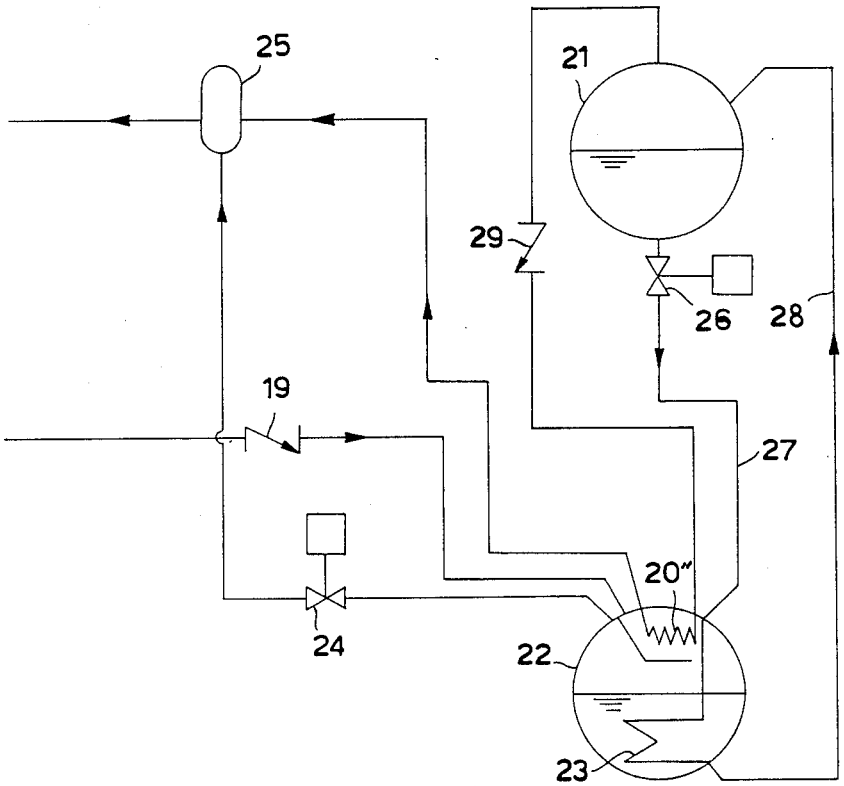
FIG. 2 shows an alternative embodiment according to the invention of one element of the process flow diagram of FIG. 1.

FIG. 2 shows the same cryogenic processing and storage system 5 for combustion products as FIG. 1 but in which said liquefying/superheating heat exchanger 20 is replaced by a coil 20" disposed within the cryogenic condensation collection vessel 22 and connected to the cryogenic oxygen tank 21 and pressure compensator 25 respectively.

Figure 3:
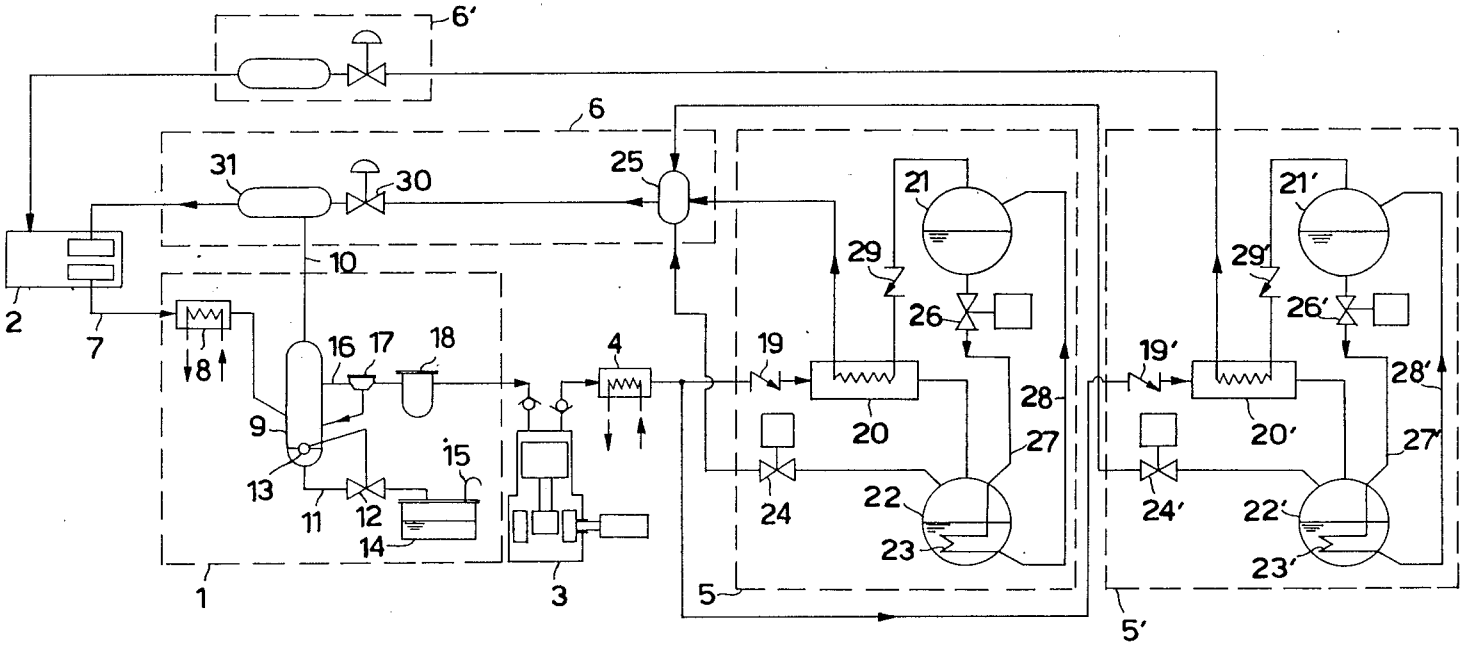
FIG. 3 is a modification according to the invention applied to the process flow diagram of FIG. 1.

Finally in FIG. 3, by means of a cryogenic processing and storage system 5' for combustion products which is analogous to said system 5 of FIG. 1, the liquefied gaseous fuel for the heat engine 2, stored in the cryogenic tank 21', is used in the same manner as the liquid oxygen to cool and liquefy part of the compressed anhydrous gases from said cooling heat exchange 4 in order to obtain a further reduction in the carbon dioxide liquefaction pressure and temperature and consequently a further reduction in the mechanical work of compression required of the compressor 3. It is apparent that in this latter modification the vaporized and superheated fuel leaving the liquefying/superheating heat exchanger 20' is simply fed to the heat engine feed 6, whereas the oxygen and inert gases present in the cryogenic carbon dioxide condensation/collection tank vessel 22' are recovered in said pressure compensator 25.

I claim:

1. A system for processing and storing the combustion products of an engine comprising:

(a) first heat exchange means for cooling the combustion products of the engine;

(b) condensate separating means for receiving said cooled combustion products from the first heat exchange means and for separating condensed combustion products from non-condensed combustion products;

(c) mixing vessel means for receiving gaseous oxygen and a first portion of said non-condensed combustion products from said condensate separating means;

(d) dehydration means for receiving a second portion of said non-condensed combustion products from said condensate separating means and for removing liquids therefrom to thereby produce an anhydrous gas containing carbon dioxide;

(e) compressor means for compressing said anhydrous gas from said dehydration means;

(f) second heat exchange means for cooling said compressed anhydrous gas and providing a first and a second stream;

(g) cryogenic oxygen supply means for storing and maintaining oxygen in a liquid state at a substantially constant pressure;

(h) first liquefying/superheating means for receiving and cooling said first stream of said anhydrous gas to thereby condense at least a portion of said carbon dioxide from said second heat exchange means and for receiving liquid oxygen from said cryogenic oxygen supply means and heating the oxygen;

(i) first cryogenic carbon dioxide condensation/collection means for storing said anhydrous gas and condensed carbon dioxide at a substantially constant temperature and pressure;

(j) liquid oxygen circulation means through which said liquid oxygen circulates in a closed loop from said cryogenic oxygen supply means and back thereto comprising at least one liquid oxygen evaporation coil means located within said first cryogenic carbon dioxide condensation/collection means;

(k) make-up oxygen control valve for receiving the gaseous oxygen from said first liquefying/superheating means and feeding said gaseous oxygen to said mixing vessel;

(l) cryogenic fuel supply means for storing and maintaining fuel in a liquid state at a substantially constant pressure;

(m) second liquefying/superheating means for receiving and cooling said second stream of said anhydrous gas to thereby condense at least a portion of said carbon dioxide from said second heat exchange means and for receiving liquid fuel from said cryogenic fuel supply means and heating the fuel;

(n) second cryogenic carbon dioxide condensation/-collection means for storing liquid carbon dioxide obtained from the second liquefying/superheating means at a substantially constant temperature and pressure; and (o) liquid fuel circulation means through which said liquid fuel circulates in a closed loop from said cryogenic fuel supply means and back thereto comprising at least one liquefield fuel gas evaporator coil means located within said second cryogenic carbon dioxide condensation/collection means.

2. The system according to claim 1 further comprising a pressure compensator for receiving the stored carbon dioxide from said first cryogenic carbon dioxide condensation collection means and the heated oxygen from said first liquefying/superheating means for regulating the pressure within said make-up oxygen control valve.

3. The system according to claim 1 wherein said first cryogenic carbon dioxide/collection means contains said first liquefying/superheating means therein and said first liquefying superheating means has at least one connection to said cryogenic oxygen supply means and to said make up oxygen control valve.

4. The system according to claim 3 wherein said first cryogenic carbon dioxide/collection means contains said first liquefying/superheating means therein and said first liquefying superheating means has at least one connecting to said cryogenic oxygen supply means and to said make up oxygen control valve.

* * * * *

UNITED STATES PATENT AND TRADEMARK OFFICE

CERTIFICATE OF CORRECTION

PATENT NO. : 4,891,939

DATED : January 9, 1990

INVENTOR(S) : Attilio Brighenti

It is certified that error appears in the above-identified patent and that said Letters Patent is hereby corrected as shown below:

Column 5, line 44, cancel "heater" insert -- heat --.
Column 6, line 36, cancel "compressor 25" insert -- compensator 25 --.
Column 6, line 48, cancel "but" insert -- by --.
Column 6, line 53, cancel "in drawn" insert -- is drawn --.
Column 6, line 58, cancel "enclose" insert -- close --.
Column 8, line 41, cancel "stored" insert -- uncondensed --.
Column 8, line 53, cancel "claim 3" insert -- claim 2 --.
Column 8, line 57, cancel "connecting" insert -- connection --.

Signed and Sealed this

Seventeenth Day of September, 1991

*Attest:*

HARRY F. MANBECK, JR.

*Attesting Officer*

*Commissioner of Patents and Trademarks*